US005108111A

United States Patent [19]

Bilodeau

[11] Patent Number: 5,108,111

[45] Date of Patent: Apr. 28, 1992

[54] MAZE BOARD GAME

[76] Inventor: Eugene Bilodeau, 2552 Fawn Ridge, Castleton, N.Y. 12033

[21] Appl. No.: 577,522

[22] Filed: Sep. 5, 1990

[51] Int. Cl.[5] ..... A63F 3/00

[52] U.S. Cl. ..... 273/249; 273/252; 273/254

[58] Field of Search ..... 273/249, 242, 243, 248, 273/250, 251, 252, 253, 254

[56] References Cited

U.S. PATENT DOCUMENTS 1,391,333 9/1921 McManus ..... 273/249
1,626,243 4/1927 Lee ..... 273/249
4,331,333 5/1982 Willcocks ..... 273/249 X
4,453,718 6/1984 Christoperson ..... 273/249

*Primary Examiner*—William H. Grieb
*Attorney, Agent, or Firm*—Schmeiser, Morelle & Watts

[57] ABSTRACT

A maze type game board having a plurality of pathways divided into spaces. Preselected spaces having directional indicators thereon so that a playing piece moving along said spaces when finishing a turn on said directional indicators must begin the next turn by moving off in the direction of said indicator. The object of the game being to travel from the start point to the finish point of the game. Said players having the option of choosing to move the playing piece down any pathway forming a part of an intersection through which the players piece is moving.

7 Claims, 1 Drawing Sheet

MAZE BOARD GAME

FIELD OF THE INVENTION

Generally, this invention relates to board games where players move their pieces from a starting point to an end point. More specifically, this invention is a maze type board game which provides different pathways, some of which may be selected by the player and some of which the player is required to travel, as the player proceeds from the starting to the finishing point.

BACKGROUND OF THE INVENTION

There is an inherent excitement found in racing to a finishing point. In fact, one might say it is basic to human nature to strive to be the first to achieve or obtain a certain finishing point. One need only to think for a few minutes to realize how many aspects of our lives involve this racing concept which in its simplest form could be a toddlers foot race. In its most complex form it may be a race such as was had when the United States and Russia were striving to be the first to land a person on the moon.

Games seem to be successful often in proportion to the way in which they imitate real life. Thus, problem solving games, question and answer games, games of physical or mental skill and myriad racing type games are common in the market place today. Depending on the complexity of these games they are suited for various age groups.

Considering the start to finish or race type games one will generally find that there is a single or primary pathway from the start to the finish. Often there are detours or side pathways which lead from the main or primary path and then return back to that path at a later point. These detours generally subject the player to certain benefits or disadvantages while traveling on the detour. Several games which are illustrative of this type of race game are marketed under the trademarks LIFE and CAREERS. These games are often more complex inasmuch as the concept of winning is clouded by the fact that these games generally use parameters to determine a winner beyond the question of who obtained the finish line first. Thus, the winner is often the one who has accumulated the most money, points or the like. Such games are generally beyond a young child's ability to analyze and reason because the child does not appreciate the various requirements for winning such a game. Thus, these games are generally suited for a child who is at least ten years old.

Other games, which are suitable for younger players also utilize a sole or primary pathway. However, instead of having detours the primary pathway has various bonus or benefit spaces and various hazard spaces. With such games the player has no decision making requirements and simply rolls the dice or spins a wheel in order to determine how many spaces his or her piece is moved on the pathway to the finish line. When the roll of the die or spin of the wheel lands the player on a hazard the players piece is generally moved backward toward the starting point. Conversely, when the roll or spin lands the player on a bonus or beneficial space the players piece is moved additional spaces forward or in some other manner advanced toward the finish line. Examples of games which illustrate this approach are marketed under the trademarks CHUTES AND LADDERS and CANDYLAND.

With this latter group of games the children can enjoy the start to finish type race but develop no reasoning or analytic abilities. In fact, I have notice that while children initially enjoy playing such games they often experience a great deal of frustration because they are provided with no choice. The child will often try to overcome this lack of choice by moving the spinner to the number he or she desires or else saying "let me spin again" when the original turn landed the player on a hazard. The parent is then faced with the uncomfortable task of either imposing the first spin upon the child causing him to land on the hazard, which, can take much of the fun out of the game, or else letting the child spin again which is still not satisfactory to the child because he or she knows that they should not have been allowed to take a second turn. Even greater frustration is encountered when the child by the luck of the roll encounters the same hazard numerous times. This leaves a child in a situation where he or she simply moves along the path subject totally to chance and feeling no sense of accomplishment in winning. Furthermore, it is my own belief that such games also tend to teach the child that the person who succeeds or wins is the person who is lucky, with virtually no emphasis upon ability.

I have thus found that for children ages 2–7 there are no suitable start to finish type games. The pathway games that have detours that lead back to the primary path have parameters for winning which are too complex for this age group. Conversely the simple start to finish race games have a variety of disadvantages as set forth above.

While I was familiar with the above games and concepts the idea for the subject invention came into being as I took my granddaughter for walks on different pathways through the woods nearby to our home. I found that she was absolutely fascinated by the realization that many different pathways could be taken that would lead through the woods. Some of these pathways even lead to the same point on the other side of the woods. Some of these pathways were rather direct and the most direct route was usually a combination of pathways that would lead us out of the woods. Other pathways wound around in various directions before finally coming out of the other side of the woods. I also realized that she quickly learned to distinguish between the pathways by recognizing unusual locations along the various pathways. It was while trying to develop a game that could be played inside on rainy days that would simulate our hikes through the woods that I developed the subject invention.

SUMMARY OF THE INVENTION

The subject invention is a game board which has a plurality of pathways that form a maze type of configuration as one travels from the starting point to the end or finish line. The pathways are divided into a number of squares or spaces so that the player may count the number of spaces to be moved during each turn. The number to move may be obtained either by use of a spinner, or a die or some other random number selection means.

The two features of the game which interact to provide both an enjoyable and challenging experience, even for younger children, is the use of directional arrows or indicators on a preselected number of spaces which, if landed upon, alter the players direction of movement, and the ability of a player to turn onto a different pathway at any intersection. When a player lands on a directional arrow at the end of a turn, he or she must begin the next turn by moving in the direction indicated by the arrow. At an intersection the player may take any pathway that proceeds from the intersection so long as the player does not reverse the direction of the piece back over the path which lead the player to the intersection. This combination allows the player to count the number of spaces which the player's piece can be moved to determine which pathway will lead most quickly to the finish line. Often choosing a particular pathway could direct the players piece toward the finish line but the end of the turn would land the player on an arrow that would either reverse the players direction or send the players piece in a direction away from the finish line. In such situations it is often advantageous to take the less direct route to the goal. This encourages the player not only to count but to plan ahead and to realize that the shortest route to a goal is not always the safest or most sure.

The playing pieces also have directional indicia on them so that the player may more easily recall the direction of movement from one turn to the next. It is an important part of this game that the direction of movement continue unchanged until the player either lands upon a directional change arrow or passes an intersection.

In the subject invention there is no single pathway that leads from the beginning to the end and thus, a combination of pathways must be chosen by the player. This provides the child with a certain amount of control over the play of the game which is more satisfying then those games where winning is left totally to chance. However, even if no directional changes are made at any intersections the players piece will eventually reach the finish line. Furthermore, almost all of the directional arrows can either be a benefit or hazard depending upon the direction that the players piece is traveling.

The game board has various areas which may be entitled with names such as the haunted forest or the witch's house or the lost bog etc. It is the purpose of these area designations to do more than simply enhance the appearance of the board but to aid, younger players who will begin to recognize the pathways by the portions of the board through which they travel. This aids the child in determining and remembering which pathway is most beneficial for traveling from the start to the finish.

I have also found by using this maze type game that the endless variations hold the players attention more then with a single or primary pathway type game. Also, by placing arrows so that no arrow is more than five spaces away from another arrow, virtually every spin, on a numbered one through six spinner, or a roll of a die can result in the placers piece landing on a directional arrow. This encourages the child to continually be forward looking.

From an attitude point of view the subject invention has no hazard which sends you back to the beginning. Instead, there are only direction changes. The child does not get the feeling that he or she must "start all over again" but instead is simply challenged to find another path to the goal. It should also be noted that many of the directional arrows can be either beneficial or not depending upon the present direction of the players piece when the arrow is landed upon. This provides the child with a much more positive viewpoint and enables an adult to redirect the child's attention from a non-beneficial landing to "what path should you take now." I have found that this aspect gives the game a positive outlook as the child is not simply sent back down the same pathway but, having the direction altered, has the opportunity to select a new path.

DESCRIPTION OF THE PREFERRED EMBODIMENT

Figure 1:
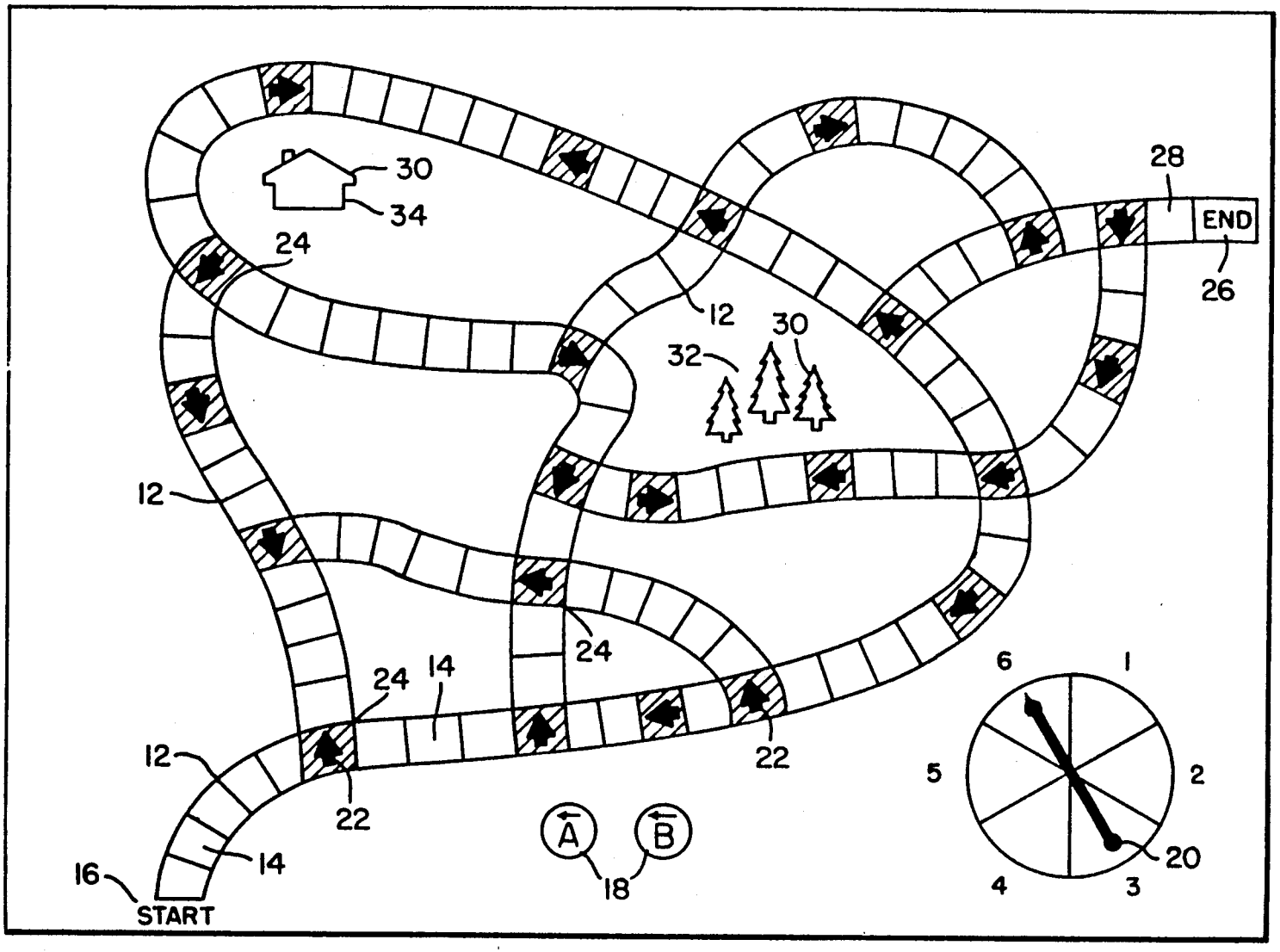
FIG. 1 is a top plan view of the game board also showing the attached spinner and playing pieces.

As shown in FIG. 1 the subject invention is set forth as a game board 10 which has a plurality of pathways 12 each of which is divided into a plurality of squares or spaces 14. The game begins at a starting point 16 and the playing pieces 18 are moved from the starting point along the first pathway for a number of spaces equal to the number obtained from the random number generator. In the preferred embodiment the random number generator is a spinner 20 with numbers ranging from 1 to 6. When a playing piece 18 lands on a square 14 having a directional indicator 22 and the players turn ends on that square the beginning of the players next turn, after obtaining a number with the spinner 20, requires the player to move the playing piece in the direction of the indicator 22. Thus, there are some directional arrows at intersection spaces and other directional arrows on spaces along the pathways that are not at the intersection of pathways. Depending on the direction of the arrow, on the spaces not at intersections, a player may have the direction of his piece reversed from one turn to the next so that on a given turn he is moving his piece back along the pathway it had traveled on the prior turn. Whenever a playing piece 18 moves past an intersection 24 the player may move the playing piece onto any of the pathways emanating from the intersection so long as the player does not reverse the course of the piece back over squares which the playing piece traveled on the way to the intersection. Thus, it can be seen that only a directional indicator 22 can reverse the course of the playing piece back over spaces traveled during the previous turn.

When a player's turn finishes on an intersection 24 on the player's next turn the playing piece must be moved in the direction of the arrow. Each intersection has a directional indicator 22. Since on the next turn the player must move in the direction of the indicator 22 he does not have the option of altering the course of the playing piece at that intersection. However, if the player has obtained a number that will move the playing piece through the intersection said piece may turn down any of the intersections pathways so long as the piece's movement is not reversed. Play continues until one of the playing pieces reaches the end square 26, which the player has to land on exactly. To this end there is a directional indicator 22 two spaces before the end square 26. Thus, a player attempting to land on the end square can be rerouted by landing on a directional indicator. However, there is also a safe square 28 between the end square 26 and the last directional indicator. This safe square allows the player to remain in safety without the possibility of being directed back into the maze until the player can spin a number 1 and land on the end square. Whichever person is first to land on the end square is pronounced the winner and play can either cease, or continue to determine second and third place if applicable.

To play, the players spin the spinner 20 with the person obtaining the highest number going first. That player then spins the spinner to obtain a particular randomly selected number and moves his or her playing piece 18 the same number of squares 14 as indicated on the number indicator. Play then continues clockwise with the next player following the same procedure and so on continuously. When a player lands on a turn ending space that has a directional indicator 22 that player during his or her next turn must advance the playing piece in the direction of the indicator 22. When any playing piece passes through an intersection the player may select any direction proceeding from the intersection except the movement of the piece backwards over the path that lead the piece into the intersection. When the playing piece lands directly in an intersection 24 it will be noted that each intersection has a directional indicator 22 which directional indicator overrides the player's choice to proceed in any direction from the intersection so that the player must, during the next turn travel in the direction of the indicator 22. Thus, when landing on a directional indicator at a turn ending space or when traveling through an intersection, the direction of the playing piece may be altered. Thus the player may have to select a new path to the end square 26 or will have a choice of selecting a new pathway. Travel through the various pathways will lead the player past location indicators 30 which may show a unique landmark such as the forest at 32 or the house at 34. These landmark indicators help the child to recall various pathways making it easier to choose the best path to the end square 26. This is helpful since an important aspect of his game is that no one pathway leads from the start to the finish.

In my preferred embodiment, when the first player reaches the end square 26 the game is over. However, when there are more than two players play may continue to determine second and third place.

While the above describes the preferred embodiment of the invention it is intended that the scope of this invention be limited only by the appended claims. It should be appreciated that many variations may be made to this game especially with regard to the number and placement of the arrows without departing from the essence of the invention as set forth in said claims. For example numerous pathways could lead off from the starting point 16 and similarly numerous pathways could end at the end square 26.

I claim:

1. A maze type board game comprising:

a starting point;

a finishing point;

a plurality of defined spaces between said start and finishing points, said spaces defining a plurality of separate, continuous and intersecting pathways for movement from said start to said finishing point; and directional indicia on preselected spaces for altering the course of a player's piece when a player's turn ends with the player landing on one of said preselected directional indicia containing spaces, some of said directional indicia being located on spaces which are at the intersection of pathways and other directional indicia being located on spaces along the pathway which are not at pathway intersections, so that from turn to turn the players piece may begin movement in one direction and finish the player's turn on a directional indicia which on the next turn reverse the movement of said piece back along the pathway it had traveled during the prior turn.

2. The invention of claim 1 wherein said pathways connect forming a plurality of pathway intersection spaces;

a majority of said intersection spaces have a directional indicator thereon; and substantially all of said directional indicia are no more than five spaces from the nearest directional indicia.

3. The invention of claim 1 wherein substantially all intersections have a directional indicator thereon; and no single pathway leads from the starting point to the finishing point so that the player must use a plurality of pathways to move from the starting point to the finishing point.

4. The invention of claim 2 further comprising player game pieces each of which has a directional indicator thereon to indicate the direction of movement of the game piece from turn to turn.

5. The invention of claim 1 wherein the spaces which do not contain directional indicia do not effect the movement or position of the player's piece.

6. A maze type game having a plurality of intersecting pathways divided into spaces for play by a plurality of players the method of playing said game comprising the following steps:

determining a first player to begin the play of the game by taking a first turn;

obtaining a randomly selected number for said first player;

moving the first players game piece over the game board a number of spaces equal to the randomly selected number without traveling over the same space twice in the same turn;

landing on a turn ending space which may have a directional indicator thereon;

continuing play with each player taking a first turn;

altering the direction of the movement of the player's game piece during their second and successive turns from the direction at the end of the previous turn to a direction defined on the turn ending space or if said turn ending space has no directional indicator continuing in the same direction as said prior turn;

reversing the direction of the movement of the player's game piece from one turn to the next when at the end of the previous turn the player landed on a turn ending space along a pathway having a directional indicator directing the player to reverse the pieces movement on the next turn so that said piece moves back along the pathway it had traveled on the prior turn; and continuing play by each player taking a turn until a player reaches a finish point on said game board.

7. The invention of claim 5 wherein during each player's turn when said turn will carry the player's piece through an intersection said player's piece upon reaching said intersection of pathways provides the further step of allowing the player to choose to follow one of the intersecting pathways as said players piece moves through said intersection.

* * * * *